US005402754A

United States Patent [19]

Gunnarsson

[11] Patent Number: 5,402,754

[45] Date of Patent: Apr. 4, 1995

[54] WET CYLINDER LINER

[75] Inventor: Gunnar Gunnarsson, Södertälje, Sweden

[73] Assignee: Saab-Scania AB, Sodertalje, Sweden

[21] Appl. No.: 168,769

[22] Filed: Dec. 16, 1993

[30] Foreign Application Priority Data

Dec. 30, 1992 [SE] Sweden ..... 9203933

[51] Int. Cl.[6] ..... F02F 1/16

[52] U.S. Cl. ..... 123/41.84; 123/193.2

[58] Field of Search ..... 123/41.79, 41.83, 41.84, 123/193.2

[56] References Cited

U.S. PATENT DOCUMENTS 4,244,330 1/1981 Baugh et al. ..... 123/41.84

5,165,367 11/1992 Morris ..... 123/41.84

FOREIGN PATENT DOCUMENTS 0206184 12/1986 European Pat. Off. .

2194588 3/1988 United Kingdom .

*Primary Examiner*—Noah P. Kamen

*Attorney, Agent, or Firm*—Ostrolenk, Faber, Gerb & Soffen

[57] ABSTRACT

A cylinder liner for a piston in an internal combustion engine with a cylinder block and a cylinder head mounted on the top of the latter. The cylinder liner is removably inserted in a cavity in the cylinder block, which cavity extends from the cylinder block upper surface down to the crankcase. The cylinder liner is axially fixed in the cavity by the cylinder head and by a bearing projection on the cavity wall, on which bearing projection a supporting projection of the cylinder liner bears. The contact area between the bearing projection and the supporting projection is situated in the region of the bottom dead center position of the lower, gas sealing, piston ring in the cylinder liner. The liner is surrounded by at least one coolant passage around the upper portion of the liner, and by a second cooling medium passage for air which is separate from the passage and which extends down to the contact area.

11 Claims, 3 Drawing Sheets

WET CYLINDER LINER

BACKGROUND OF THE INVENTION

The present invention relates to a wet cylinder liner for a cylinder of an internal combustion engine, and particularly to the support for the liner in the cylinder head and to the cooling of the liner.

A cylinder liner of the "wet" type is a cylinder liner the outside of which is to at least a certain extent in direct contact with and flowed over by a cooling medium, usually the radiator fluid.

The invention concerns more specifically a further development of the type of wet cylinder liner usually called a "midstop" liner. This means a wet cylinder liner which is so placed in the cavity in the cylinder block in which the liner is inserted that the liner is supported in the radial direction of the cavity wall at a position located approximately halfway between the two ends of the liner, i.e. at the top at the upper end adjacent to the cylinder head, and at the bottom at the lower end, which faces into the crankcase. In the following text, the respective expressions "upper" and "lower" end or portion of the liner merely denote respectively the end/portion facing the cylinder head and the end/portion facing away from the cylinder head and downwards into the crankcase. They are thus completely independent of the actual orientation of the cylinder block in the engine compartment of the vehicle concerned or in relation to a vertical direction.

An example of a wet cylinder liner of the type initially referred to is the removable cylinder liner described in U.S. Pat. No. 4,244,330. This known liner is precisely of the "midstop" type. On its outer shell surface this known cylinder liner has a circumferential radial protrusion which bears on a circular supporting surface on the cavity wall in the cylinder block. From the heat transfer point of view, the radial protrusion divides the cylinder liner into an upper portion cooled by water and a lower portion not cooled by water. This design is advantageous from the heat distribution point of view because it enables effective cooling of the upper hottest portion of the liner while at the same time the lower portion of the liner is not cooled by water but maintains a heat created by combustion in the combustion chamber of the cylinder and thereby causes lower friction losses than would otherwise occur. In addition, cooling losses are less with a cylinder liner of the "midstop" type because the cooled surface of the liner is thereby smaller.

When the engine's cylinder head is fitted to the cylinder block (the engine block), the cylinder liner is deformed by the clamping forces which occur when the cylinder head is pressed against the cylinder head gasket and the upper portion of the cylinder liner by means of a number of bolts. The deformations do in principle occur over the whole liner but may only be harmful within the area where they are most severe, i.e. where the circular protrusion of the liner bears on the supporting surface in the cavity wall. In order to prevent these deformations resulting in damage to the piston moving to and from in the cylinder liner, it is necessary to provide the piston with relatively large clearances. However, this is disadvantageous because increased piston clearances result in corresponding increases in noise level, in fuel consumption and in propensity to carbon grinding. Piston ring wear also becomes greater and at the same time the risk of cylinder cavitation increases because of the piston's positive and negative pressures. These pressures are a consequence of the fact that the lower portion of the piston is subjected via the gudgeon pin to forces which are directed obliquely with respect to the axial center line of the cylinder liner and the piston. Owing to the piston clearance, these obliquely directed forces create the possibility of a certain tilting or oblique positioning of the piston in the liner.

The disadvantages outlined above of such a known cylinder liner of the "midstop" type are well-known to engine designers but no satisfactory solution to the underlying problems has hitherto appeared.

SUMMARY OF THE INVENTION

The primary object of the invention is to utilize the known advantages of the "midstop" liner to minimize or preferably completely avoid these likewise known disadvantages discussed above. The intention therein is to be able to achieve this at the same time as also reducing the piston clearance. The fundamental idea of the invention in this respect is to design the cylinder liner and its associated cavity in the cylinder block such that the deformations can not only be minimized but also (and this is the primary aim) be made to occur at a different point where they lead to less damage and cause less problems than occur with known "midstop" liners.

Another object of the invention is to also reduce the magnitude of the deformations by making the cylinder liner have different thicknesses of material in different portions of it so that a more optimum design from the strength and deformation points of view can be achieved.

The objects stated above are achieved with the invention by having the bottom support of the cylinder liner in the cavity of the cylinder head located near to the area of contact of the gas sealing ring on the piston with the cylinder liner when the piston is at the bottom reciprocation position and by having separated coolant passages around the liner, one toward the cylinder head above and another in the vicinity of the gas sealing ring of the piston when the piston is in its bottom position. Details of these features are described below.

The particularly distinguishing feature of the cylinder liner according to the invention is that the contact area between the bearing projection on the cavity wall and the supporting projection on the liner are situated in the region of, and preferably just below, the bottom dead center position of the circular area on the piston where the gas tight piston rings sit. At the same time, the cylinder liner is surrounded not only by a coolant passage around the upper part of the liner but also by a distinct cooling medium space which is separate from the coolant passage and is with advantage intended for a different cooling medium than the fluid in the coolant passage. This cooling medium space extends downwards to the contact area between the bearing projection and the supporting projection.

The deformations discussed above that occur on known "midstop" liners are not in themselves eliminated by the contact area being situated low, at the bottom dead center position of the gas seal rings, but the deformations will now only occur at the bottom dead center position of the "gas ring package", when the piston is of course moving relatively slowly. As the piston is moving relatively slowly, the rings have time to follow the deformed cylinder wall and so the deformations that occur will not be harmful to the piston despite there being very little piston clearance.

The cooling medium in the separate cooling medium space is preferably air and the space is suitably in communication with the surrounding atmosphere via a duct in the cylinder block. The cooling medium space filled with air makes it possible to have a cooling water seal placed high on the outside of the cylinder liner despite the fact that the counterpart (i.e. the bearing projection/the supporting projection) to the protrusion/supporting surface which in the known cylinder liner design separates the cold portion of the liner from its uncooled portion has been shifted downwards according to the invention, i.e. towards the crankcase.

The contact area between the bearing projection and the supporting projection is located suitably on the lower half of the cylinder liner within a band of longitudinal range the lower and upper limits of which lie preferably at respective distances of L/6 and 2L/6 from the lower edge of the liner, L being the total actual length of the liner.

The actual extent of the cooling medium space should not exceed 60% of L nor be less than at least 15% of L.

For further reduction of the magnitude of the deformations the wall thickness of the cylinder liner may also be modified so that the liner has increased wall thickness where the deformations are directed radially inward, and reduced wall thickness where they are directed radially outward.

The coolant passage is suitably formed by the cylinder liner having in its upper portion an external contraction (a shallow circumferential groove) which together with an opposite portion of the cavity wall delineates the coolant passage. The cooling medium space is formed in its turn by the cylinder liner having in its portion above and adjacent to the supporting projection an external contraction (likewise a shallow groove) which together with an opposite portion of the cavity wall delineates the cooling medium space.

BRIEF DESCRIPTION OF THE DRAWINGS

The invention is further clarified and described below with reference to an embodiment example illustrated in the accompanying drawings.

Other features and advantages of the present invention will become apparent from the following description of the invention which refers to the accompanying drawings.

DESCRIPTION OF A PREFERRED EMBODIMENT

Figure 1:
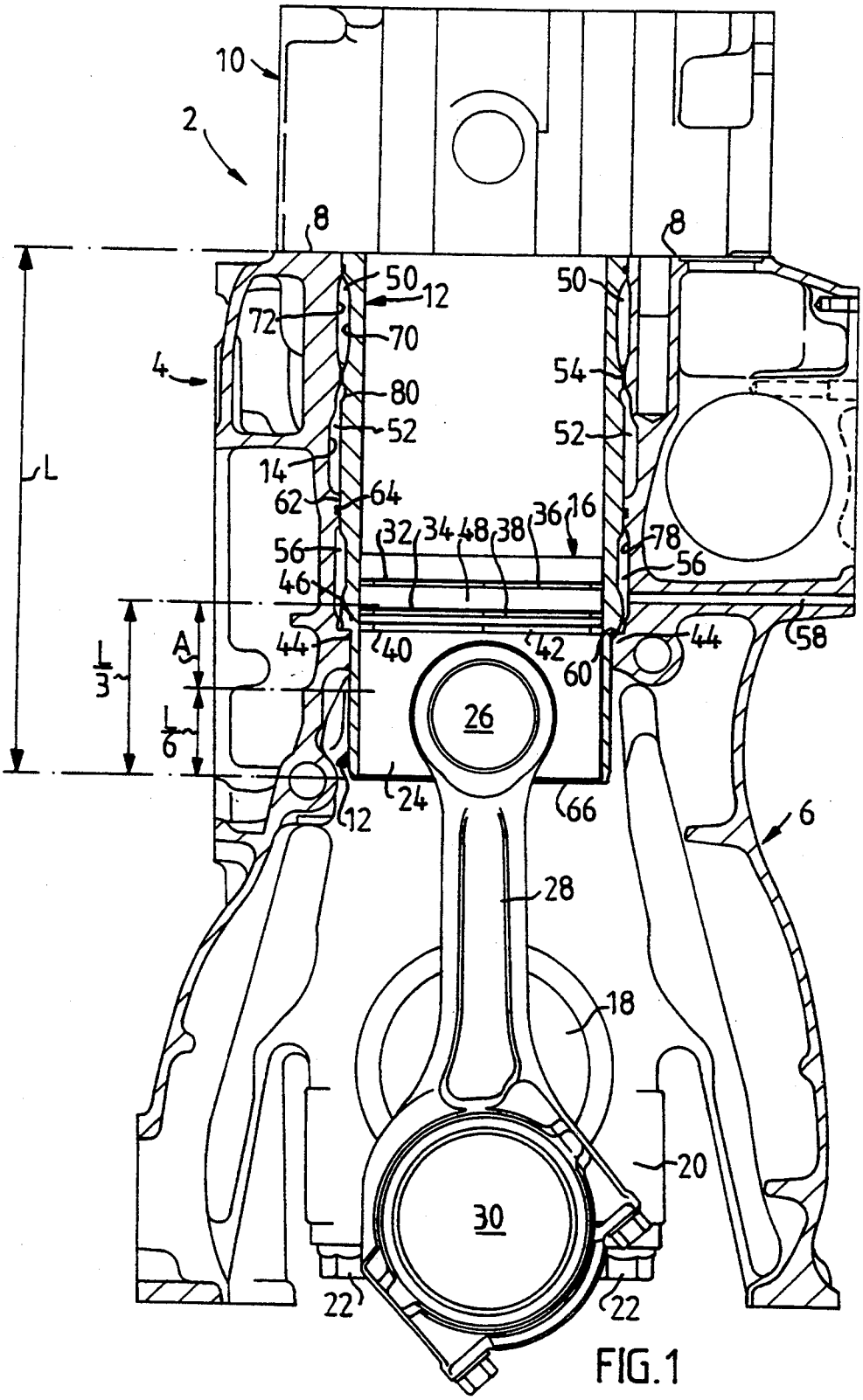
FIG. 1 a vertical cross-section through an internal combustion engine with a wet cylinder liner according to the invention.

Reference will now first be made to FIG. 1, which shows an internal combustion engine 2 which includes a cylinder block 4 which is integrated with a crankcase 6 beneath to form an undivided engine block. A cylinder head 10 is mounted on the face-ground upper surface 8 of the cylinder block 4. Between the cylinder block upper surface 8 and the underside of the cylinder head 10 there is in the usual manner a cylinder head gasket (not depicted here) which forms a gas and fluid tight seal between these engine parts. This undepicted cylinder head gasket is in the usual manner compressed to achieve the sealing effect by the cylinder head and cylinder block being drawn together by means of bolts not here depicted. This compression causes an axial force effect on the cylinder liner, which is thereby deformed (the liner wall is deflected in the transverse direction). The cylinder bore comprises a wet cylinder liner 12 which is removably inserted in a cavity 14 in the cylinder block 4. This cavity extends from the cylinder block upper surface 8 down to the upper portion of the crankcase 6. An engine piston 16 is inserted in the cylinder liner 12 for reciprocating movement. In the crankcase 6 the engine's crankshaft 18 is supported in the engine block by means of crankshaft bearings, one portion 20 of which is depicted in the diagram with relating bearing bolts 22. A transverse gudgeon pin 26 is inserted in the piston 16. The piston 16 is connected to the crankshaft 18 by a connecting rod 28 which bears at the top on the gudgeon pin 26 and at the bottom on a crankpin 30 inserted in the crankshaft.

The piston has in its upper portion three circumferential grooves, the two upper ones 32, 34 of which accommodate a pair of gas sealing rings 36, 38, while the lower groove 40 accommodates an oil scraper ring 42.

The cylinder liner 12 is fixed axially in the cavity 14, at the top by means of the cylinder head 10 and at the bottom by means of a circular bearing projection 44 on the lower portion of the cavity wall. The cylinder liner is supported on the bearing projection 44 by means of a circular supporting projection 46 on the outside of the liner. The bearing projection 44 and the supporting projection 46 bear on one another over a circular contact area 60 which is situated just below the bottom dead center position depicted in FIG. 1 of the lower gas sealing ring 38. The two gas sealing rings 36 and 38 are 10 placed respectively at the upper and lower edges of a circular shell area 48 on the piston 16.

Figure 2:
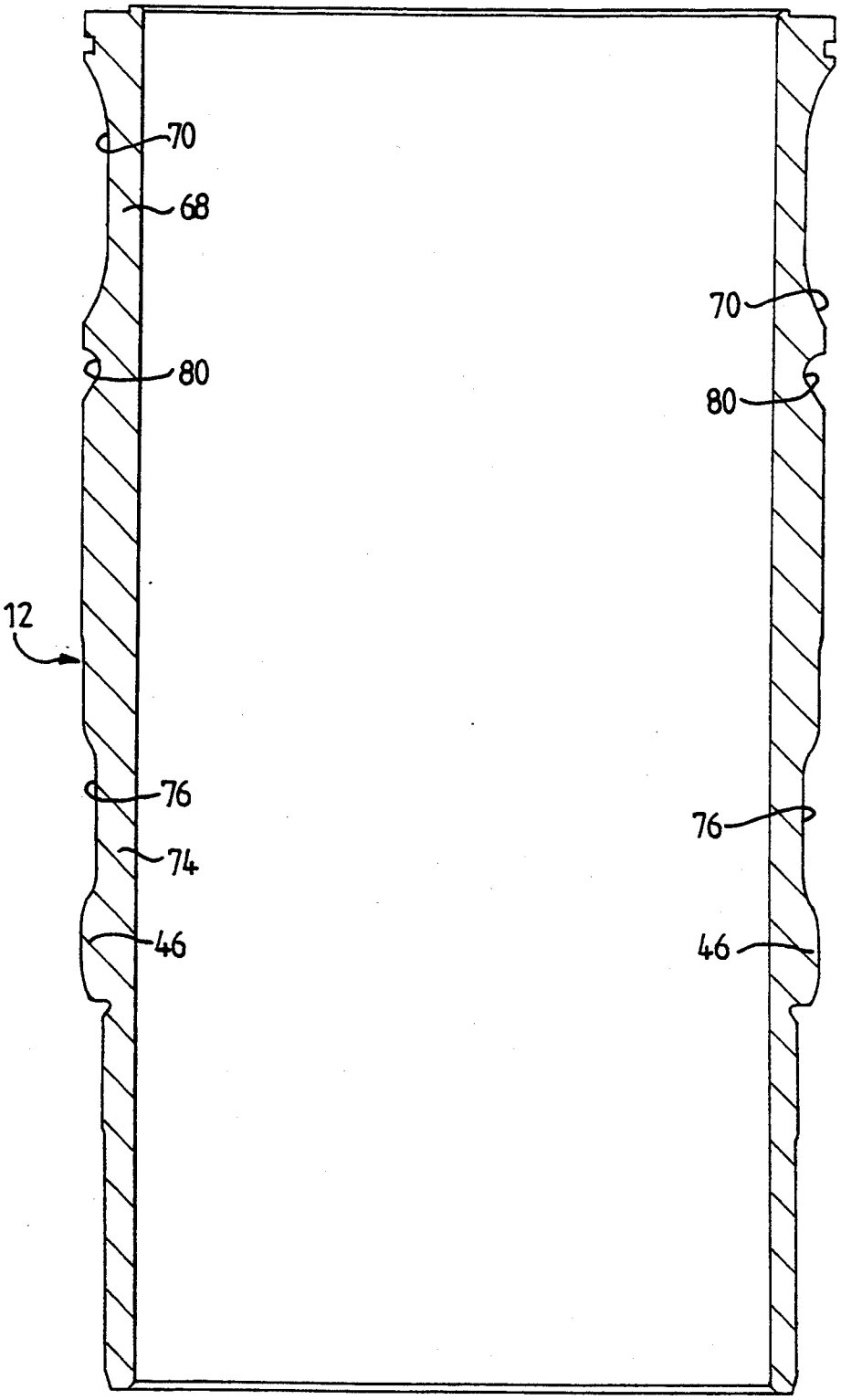
FIG. 2 shows the cylinder liner according to FIG. 1 on a larger scale.

The cylinder liner 12 is surrounded in its upper portion by a pair of circumferential coolant passages 50 and 52 which communicate with one another at 54. In its lower half the cylinder liner 12 is also surrounded by a distinct cooling medium space 56 which is separate from the passage 52, is intended for air and communicates with the atmosphere surrounding the engine via a duct 58 in the cylinder block 4. In the axial direction of the liner 12 the cooling medium space 56 extends from the contact area 60 between the bearing projection 44 and the supporting projection 46 to a sealing portion 62 of the cavity wall which surrounds the liner. The space 56 has an axial length up to a maximum of 60% of the total length of the cylinder liner and at least 15% of that total length. In its surface which faces the outside of the cylinder liner 12, the sealing portion 62 accommodates a sealing gasket 64 which prevents interchange of medium between the coolant passage 52 and the air filled space 56. The contact area 60 between the bearing projection 44 and the supporting projection 46 should suitably be placed within the axial longitudinal range A, the upper limit of which is situated at the distance of $1/3 \times L$ and the lower limit at the distance of $1/6 \times L$ from the lower edge 66 of the liner 12, which faces the inside of the crankcase 6. As depicted in FIG. 1, L denotes the total axial length of the liner. Reference will now be made to FIG. 2, which depicts on a larger scale the cylinder liner 12 according to FIG. 1. In its upper portion 68 facing towards the cylinder head (see 10 in FIG. 1), the cylinder liner 12 has a shallow circumferential groove 70 which together with an opposite portion (see 72 in FIG. 1) of the cavity delineates the coolant passage 50. In its portion 74 just above the supporting projection 46, the cylinder liner also has a shallow circumferential groove 76 which together with an opposing portion 78 of the cavity wall delineates the cooling medium space 56. Just below the shallow groove 70, the cylinder liner 12 also has a circumferential groove 80 which forms an upper extension of the coolant passage 52 whereby the latter communicates with the coolant passage 50 via the connection point 54.

Both the portions 72 and 78 of the cavity wall 14, which respectively delineate the coolant passage 50 and the cooling medium space 56, and the portion of the cavity wall which outwardly delineates the coolant passage 52, also preferably take the form of shallow grooves.

Figure 3:
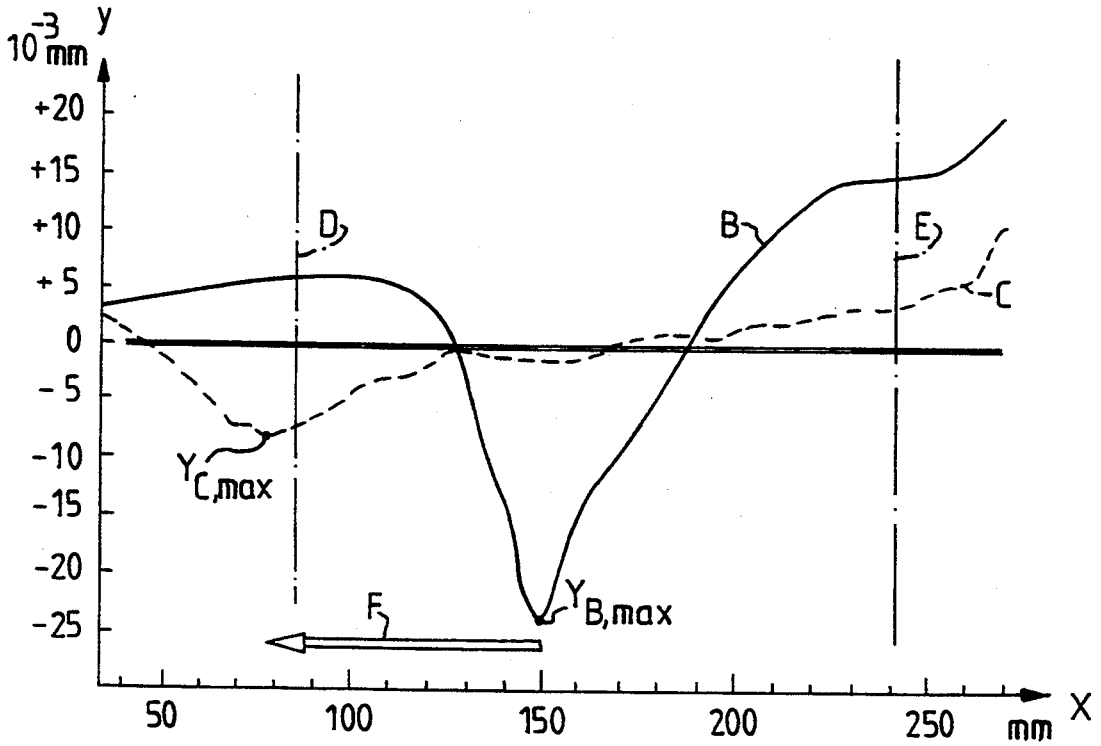
FIG. 3 is a diagram showing how the deformation of the cylinder liner wall varies in the axial longitudinal direction of the liner.

We now go on finally to consider the diagram depicted in FIG. 3, which shows in graphic form how the deformation (the deflection) of the cylinder liner wall varies in the axial direction of the cylinder liner. In this diagram, the x-axis represents the axial distance along the cylinder liner 12 from the lower edge 66 of the liner (see FIG. 1) and the y-axis the deformation of the cylinder wall, i.e. its positive or negative deflection from the undeformed position corresponding to y=O.

Curve B in the diagram represents the variation in cylinder liner wall deflection of a known cylinder liner, while the broken curve C shows how cylinder wall deformation varies along a wet cylinder liner according to the present invention. The vertical chain-dotted line D denotes the bottom dead center position of the lower gas sealing ring 38, while the vertical chain-dotted line E denotes the top dead center portion of the gas sealing ring 38.

The maximum value of the deformation shown by curve B of a cylinder liner according to known technology is marked $Y_{b,max}$ in FIG. 3, while the maximum value for the deformation represented by curve C of a cylinder liner according to the invention is marked $Y_{c,max}$. From the diagram it is clear that the invention achieves both an appreciable reduction in the maximum value of the deformation and, still more important, a shifting of the position of this maximum deformation to a point where the deformation occurring is not harmful to the piston because the latter moves slowly in this region. The most significant effect achieved by the invention is thus the resulting downward "shifting" of the position of the value $Y_{max}$ in the cylinder wall. This "downward shift" of the point or position of maximum deformation is illustrated in FIG. 3 by the arrow F which shows how the position of the maximum value is shifted downwards below the bottom dead center position of the gas sealing ring 38.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A wet cylinder liner for defining the cylinder bore for a piston of an internal combustion engine, wherein the engine comprises: a cylinder block having an upper surface, a cylinder head mounted on the upper surface of the cylinder block, and a crankcase beneath the cylinder block, the crankcase having a top;

a cavity defined by a wall inside the cylinder block, the cavity being for receiving the cylinder liner, the cavity extending through the cylinder block from the upper surface of the cylinder block to the top of the crankcase; a circular bearing projection on the wall of the cavity down from the upper surface of the cylinder head and up from the top of the crankcase;

the cylinder liner being adapted for receiving a piston which moves reciprocatingly through the cylinder liner; the cylinder liner being disposed in the cavity, and being of a height to extend to the top of the cylinder head, and being so shaped as to be axially fixed in the cavity at the top of the cavity by the cylinder head;

the cylinder liner having an outside with a circular supporting projection thereon positioned to rest on the cooperating circular bearing projection on the cavity wall, thereby to support the cylinder liner from the bottom, and the cylinder liner extending down from the circular supporting projection toward the crankcase;

a first coolant passage defined between the cavity wall and the outside of the liner and surrounding the liner for receiving coolant for cooling the liner, the first coolant passage being located above the circular bearing projection;

at least one annular, gas sealing, piston ring around the piston which engages and gas seals the piston in the cylinder liner; the bearing projection on the liner being so placed along the height of the liner that it is positioned generally at the height of the piston ring when the piston is in the bottom dead center reciprocation position;

a second coolant passage, separate from the first coolant passage, defined between the cavity wall and the outside of the liner and surrounding the liner and being located along the liner generally in the vicinity of the contact area between the piston ring and the cylinder liner when the piston is in the bottom dead center reciprocation position.

2. The wet cylinder liner of claim 1, wherein the bearing projection is located just below the piston ring when the piston is at the bottom dead center reciprocation position.

3. The wet cylinder liner of claim 1, wherein the cylinder block has a flat upper surface.

4. The wet cylinder liner of claim 1, wherein the cylinder liner extends down to the top of the crankcase.

5. The wet cylinder liner of claim 1, wherein the bearing projection and the supporting projection meet at a circular contact area on the liner, which is situated along the lower half of the cylinder liner more toward the crankcase than toward the cylinder head.

6. The wet cylinder liner of claim 5, wherein the contact area between the piston ring and the cylinder liner is situated within an axial longitudinal range along the cylinder liner having a lower limit a distance up from the lower edge of the liner of 1/6 the total length of the liner and having an upper limit a distance up from the lower edge of the liner of 1/3 the total length of the liner.

7. The wet cylinder liner of claim 1, wherein the second coolant passage is connected with air.

8. The wet cylinder liner of claim 7, further comprising a duct in the cylinder block communicating between the atmosphere and the second coolant passage.

9. The wet cylinder liner of claim 1, wherein the second coolant passage has an axial length along the length of the cylinder liner up to a maximum of 60% of the total length of the cylinder liner.

10. The wet cylinder liner of claim 9, wherein the second coolant passage has an axial length along the cylinder liner of at least 15% of the total length of the cylinder liner.

11. The wet cylinder liner of claim 1, wherein the liner has an upper portion near the cylinder head;

the cylinder liner upper portion has a first external, radial contraction for defining a first shallow circumferential groove;

the cavity being defined by a wall which includes a first recess opposite the first shallow groove for together defining the first coolant passage;

in the portion of the cylinder liner immediately above the supporting projection, the cylinder liner having a second external, radial contraction for defining a second shallow circumferential groove;

the cavity wall having a second recess opposite the second shallow groove for together defining the second coolant passage.

* * * * *